US005137694A

United States Patent [19]

Copeland et al.

[11] Patent Number: 5,137,694

[45] Date of Patent: Aug. 11, 1992

[54] INDUSTRIAL SOLID DETERGENT DISPENSER AND CLEANING SYSTEM

[75] Inventors: James L. Copeland, Burnsville; Henry A. Snyder, St. Paul; Sherwood A. Bergseid, Minneapolis; Thomas H. Indieke, Hastings, all of Minn.

[73] Assignee: Ecolab Inc., Saint Paul, Minn.

[21] Appl. No.: 277,898

[22] Filed: Nov. 30, 1988

Related U.S. Application Data

[60] Division of Ser. No. 90,860, Aug. 28, 1987, abandoned, which is a continuation-in-part of Ser. No. 732,253, May 8, 1985, abandoned.

[51] Int. Cl.[5] ..... B05B 12/02

[52] U.S. Cl. ..... 422/106; 134/56 D; 134/57 D; 137/5; 137/93; 137/268; 137/563; 222/52; 222/318; 239/127; 366/136; 366/137; 366/159; 422/108; 422/110; 422/263; 422/266; 422/275; 422/281

[58] Field of Search ..... 422/106, 108, 110, 263, 422/266, 275, 281; 137/5, 93, 268, 563; 222/52, 318; 366/136, 137; 239/1, 127; 134/56 R, 56 D, 57 R, 57 D

[56] References Cited

U.S. PATENT DOCUMENTS

| | | | |
|---|---|---|---|
| 404,354 | 5/1889 | Huber . | |
| 1,740,879 | 12/1929 | Sonner . | |
| 1,798,428 | 3/1931 | Lindgren . | |
| 1,932,070 | 10/1933 | Grant et al. | 141/9 |
| 1,945,351 | 1/1934 | Grafton | 220/62 |
| 1,949,264 | 2/1934 | Bagley | 226/69 |
| 1,988,000 | 1/1935 | Estler | 225/12 |
| 2,031,853 | 2/1936 | Potts | 226/93 |
| 2,083,076 | 6/1937 | Mau | 23/263 |
| 2,120,807 | 6/1938 | Kundel | 299/34 |
| 2,138,943 | 12/1938 | Sinkwich | 141/9 |
| 2,238,969 | 4/1941 | Butterfield | 299/84 |
| 2,288,791 | 7/1942 | Culliton | 299/83 |
| 2,308,612 | 12/1943 | Lehmkuhl | 23/272 |
| 2,370,609 | 2/1945 | Wilson et al. | 175/183 |
| 2,371,720 | 3/1945 | Stine | 299/83 |
| 2,382,163 | 8/1945 | MacMahon | 252/128 |
| 2,382,164 | 8/1945 | MacMahon | 252/138 |
| 2,382,165 | 8/1945 | MacMahon | 252/135 |
| 2,387,945 | 10/1945 | McDow | 299/84 |
| 2,412,819 | 12/1946 | MacMahon | 252/138 |
| 2,477,996 | 8/1949 | McCowan | 299/83 |
| 2,513,566 | 7/1950 | Kent | 299/84 |
| 2,604,386 | 7/1952 | Arant | 23/209 |
| 2,613,922 | 10/1952 | Gatchet | 259/4 |
| 2,738,323 | 3/1956 | Tepas, Jr. | 210/28 |
| 2,820,701 | 1/1957 | Leslie | 23/271 |
| 2,920,417 | 1/1960 | Wertheimer | 45/28 |
| 3,070,316 | 12/1962 | Miville | 239/312 |
| 3,227,524 | 1/1966 | White | 23/267 |
| 3,507,624 | 4/1970 | Schneider et al. | 23/271 |
| 3,574,561 | 4/1971 | Nickerson et al. | 23/282 |
| 3,578,776 | 5/1971 | Schneider et al. | 137/268 |
| 3,579,440 | 5/1971 | Bradley, Jr. | 210/18 |

(List continued on next page.)

*Primary Examiner*—Timothy M. McMahon
*Attorney, Agent, or Firm*—Merchant, Gould, Edell, Smith, Welter & Schmidt

[57] ABSTRACT

A cleaning system and dispenser are disclosed which feature a reservoir for retaining a liquid detergent solution; a chamber for retaining a mass of solid, dissolvable detergent; a measurement device for measuring the concentration of detergent in the liquid detergent solution; and a flow control device for circulating the liquid detergent solution from the reservoir into contact with the solid detergent so as to dissolve a portion of the solid detergent and increase the concentration of detergent in the liquid detergent solution. The circulation of the liquid detergent solution is in response to a signal from the concentration measuring device that the concentration of detergent in the liquid detergent solution has fallen below a predetermined minimum. The dispenser also includes a measurement device for measuring the volume of solution in the reservoir and for adding fresh water to the reservoir when the volume of solution is below a predetermined minimum. The dispenser also includes flow control apparatus for dispensing the solution from the reservoir to a use point.

21 Claims, 3 Drawing Sheets

U.S. PATENT DOCUMENTS 3,595,438 7/1971 Daley et al. ..... 222/67
3,598,372 8/1971 Schneider, Jr. ..... 261/110
3,680,070 7/1972 Nystuen ..... 340/244
3,727,889 4/1973 Nagel ..... 259/1
3,734,776 5/1973 Keogh, Jr. ..... 134/25
3,816,427 6/1974 Loliger et al. ..... 23/271
3,833,417 9/1974 Griparis ..... 134/22
3,850,344 11/1974 Burge et al. ..... 222/67
3,864,090 2/1975 Richards ..... 23/267
3,933,169 1/1976 Halley ..... 137/268
4,020,865 5/1977 Moffat et al. ..... 137/268
4,063,663 12/1977 Larson et al. ..... 222/52
4,250,911 2/1981 Kratz ..... 137/268
4,426,362 1/1984 Copeland et al. ..... 422/263
4,462,511 7/1984 Fulmer et al. ..... 222/52
4,569,780 2/1986 Fernholz et al. ..... 252/90
4,569,781 2/1986 Fernholz et al. ..... 252/92
4,571,327 2/1986 Larson et al. ..... 422/263
4,627,457 12/1986 Bird et al. ..... 137/1
4,687,121 8/1987 Copeland ..... 222/64
4,690,305 9/1987 Copeland ..... 222/52

INDUSTRIAL SOLID DETERGENT DISPENSER AND CLEANING SYSTEM

This is a division, of application Ser. No. 07/090,860, filed Aug. 28, 1987, which was a continuation-in-part of application Ser. No. 732,253, filed May 8, 1985 both of which are now abandoned.

BACKGROUND OF THE INVENTION

1. Field of the Invention

The first aspect of our invention relates generally to industrial cleaning apparatuses, and more specifically to apparatuses for regulating the detergent concentration of an aqueous cleaning solution by recirculating used cleaning solution through a chamber containing solid detergent.

The second aspect of our invention relates generally to spray-type dispensers used to create and dispense a chemical solution from a solid block of the chemical, and more specifically to spray-type dispensers which form a chemical solution of substantially constant concentration from a solid block of chemical by adding fresh water to the solution and dissolving the chemical block with solution as necessary.

2. Description of Related Technology

Many industrial cleaning applications require that large objects, such as engine blocks, be soaked in or sprayed with an aqueous detergent solution. The nature of the object being cleaned in conjunction with the design limitations of the cleaning apparatus often prevent significant agitation of either the object or the solution during cleaning. Effective cleaning can therefore only be accomplished by the use of a powerful cleaning agent such as potassium hydroxide. Due to the adherent nature of the accumulated deposits typically encountered in such situations, the residence times of the objects in the cleaning vat or chamber may be several hours. Since the cleaning chambers often have capacities of 1000 gallons or more, frequent changes of the aqueous detergent solution is impractical. The same solution may remain within the tank for months.

The caustic cleaning agents typically employed in industrial cleaning are produced commercially in particulate form such as flakes, powder, beads, crystals, etc and are introduced directly into the water in the cleaning vat or chamber by means of a shovel or small container. The particles present a relatively large surface area as compared to their total volume and, when suddenly introduced into the water in the vat, often produce a violent exothermic reaction. The production of steam can occur so rapidly that hot, caustic liquid may splatter, endangering the person placing the particles in the vat.

Alternately, the detergent may be hand-fed into an intermediate dissolving chamber and then subsequently contacted with water in order to dissolve the detergent before its introduction into the cleaning tank.

The instantaneous concentration of the aqueous detergent solution can vary considerably when the cleaning agent is introduced into the intermediate chamber in this manner, since the most soluble ingredients and those with the smallest particle size will dissolve first. Such variations in concentration of the various detergent components are wasteful of detergent and result in a poorly controlled cleaning operation.

In order to avoid the hazards associated with dry particulate detergent, some manufacturers dissolve the detergent in water and supply the resulting liquid detergent to the customer. Although this method is safer, the resulting solution is typically at least 70% water in order to maintain solubility of the detergent components during typical shipping and storage conditions. The customer is therefore required to pay a premium for water as the water must be blended, packaged, stored and shipped.

An ideal cleaning system would include a means for (i) constantly measuring the detergent concentration in the cleaning solution, (ii) maintaining a constant detergent concentration, (iii) safely introducing additional detergent into the cleaning solution when required to maintain a constant detergent concentration (hopefully by a relatively passive, if not automatic, means not requiring handling of the material by an operator), and (iv) recycling the aqueous detergent solution so that water, cleaning agent and energy are conserved to the maximum extent possible. Further, the system must lend itself to cleaning operations which take up to several hours per object, while requiring complete replacement of the cleaning solution only once a month or so.

The best choice for a detergent would be a solid having the lowest possible ratios of surface area/volume and surface area/weight.

One approach used by cleaning system designers to achieve the goal of obtaining a constant aqueous detergent solution concentration is to continuously supply detergent to the solution at a constant rate. For example, U.S. Pat. No. 2,371,720, issued to Stine, discloses a method whereby a granular cleaning agent (C) is placed within a chamber on a screen (8) so as to present a uniform surface area to a continuous spray of water (W). The eroding effect of the water as it contacts the cleaning agent causes a highly concentrated aqueous detergent solution to flow by gravity into a cleaning tank. The system is designed so that even though the detergent supply gradually diminishes the surface area of the detergent in contact with the water remains relatively constant. The amount of water supplied by the spray nozzle is controlled solely by conventional, manually controlled valves or alternatively, a proportioning valve which supplies an amount of water to the spray nozzle which is proportional to the amount of water which is simultaneously being supplied to the cleaning vat or chamber. Although this system is mechanically simple, its ability to continuously supply detergent at a constant rate is inhibited by the tendency of the detergent particles to pack or harden during idle periods when the water supply is intentionally interrupted.

A closed loop system employing a constant rate detergent dispensing device is disclosed in U.S. Pat. No. 3,066,520, issued to Jennings. In the Jennings system, a predetermined amount of a granular detergent (40) is placed in a chamber (39), wherein the detergent is continuously subjected to a stream of water which is diverted from a main washing basin (4). The amount of granular detergent placed within the chamber is based upon an idealized assumption of the rate of detergent consumption in the washing basin. No method of measuring the actual detergent concentration in the washing basin is provided, which, while suitable for cleaning operations of relatively short duration, is unsuitable for operations which extend for a period of hours or days during which time the rate of detergent consumption may be highly variable.

A more sophisticated closed loop cleaning system is disclosed in U.S. Pat. No. 3,355,324, issued to Catzen.

The Catzen device continuously recirculates aqueous detergent solution past a concentrated detergent solution source (30), but limits the amount of concentrated detergent solution that is added to the aqueous detergent solution by means of a valve (38). The valve is operated manually based upon a predetermined sequence of events. No method is provided for actually measuring detergent concentration in the aqueous detergent solution.

An apparatus that does monitor various parameters in a closed loop cleaning system is disclosed in U.S. Pat. No. 4,076,554, issued to Weihe. However, the Weihe device measures only fluid flow rates in an attempt to monitor the cost of operating the cleaning system.

U.S. Pat. No. 3,595,252, issued to Conte, discloses a closed loop monitoring system used in conjunction with a glassware cleaning apparatus. The Conte device utilizes conductivity measuring means to ascertain the specific resistance of the water used to clean the glassware and thereby determine the degree of purity of the water. The Conte device cleans only with deionized water and therefore does not address the problems associated with the introduction of detergent into the cleaning media.

A recirculating cleaning system is disclosed in U.S. Pat. No. 3,085,416, issued to D'Hooge. The D'Hooge device constantly recirculates aqueous detergent solution past a hygrometer which measures the relative humidity of the air immediately above the solution. When the humidity drops below a certain level, a valve automatically opens and introduces additional water into the cleaning basin from a separate tank. If the relative humidity rises above a certain level, additional detergent is supplied from a separate container to the main cleaning basin by means of a remotely operated valve. Thus, in the D'Hooge system the aqueous detergent solution is recirculated only to facilitate sampling and does not play a direct role in increasing or decreasing the concentration of the solution.

Another concentration monitoring and adjustment system is disclosed in U.S. Pat. No. 4,463,582, issued to Saalmann. The Saalmann device continuously measures detergent concentration in the main washing basin. When the concentration drops below some preset value, additional dry cleaning agent is mixed with water at a separate location and then introduced into the main washing basin. This system has the advantage of permitting a caustic substance to be mixed in relative isolation and introduced into the tank without interaction by a human operator.

Each of the devices herein described, while satisfactory for their intended purpose, leaves something to be desired that they are complex in design, costly, require the proper execution of a variety of sequential steps and/or are inefficient in the utilization of water, cleaning agent and/or energy.

Dispenser

Several industrial applications require the formation and dispensing of an aqueous chemical solution from a solid, as opposed to particulate, form of the chemical. One such device is the spray-type dispenser which forms a concentrated chemical solution from a solid block of the chemical by spraying the solid block of chemical with water so as to dissolve a portion of the chemical block. The chemical solution thus formed is then allowed to immediately pass out of the device and can be either directed to its utilization point or stored in a reservoir.

While overcoming the problem of varying solubility rates of various components in the solid chemical, one difficulty encountered with spray-type dispensers is their inability to form a chemical solution of substantially constant concentration over the entire lifetime of a single block of chemical.

A first approach at overcoming the difficulty is presented in U.S. Pat. No. 3,595,438, issued to Daley, which discloses a spray-type dispenser for converting particulate detergent into a concentrated detergent solution by spraying a mass of the detergent with water in response to a signal that the volume of detergent solution retained within a reservoir has decreased below a preset amount.

A second approach at overcoming the difficulty is presented in U.S. Pat. No. 4,020,865, issued to Moffatt et al, which discloses a spray-type dispenser for converting particulate detergent into a concentrated detergent solution by spraying a mass of the detergent with detergent solution from a reservoir of the solution whenever solution is dispensed from the reservoir. Make-up water is added directly to the reservoir.

A third approach at overcoming the difficulty is presented in U.S. Pat. No. 4,063,663, issued to Larson, which discloses a spray-type dispenser for converting particulate detergent into a concentrated detergent solution by spraying a mass of the detergent with fresh water in response to a signal from a pair of electrodes in the use solution that concentration of detergent in the use solution is below a predetermined minimum.

While each of the Daley, Moffatt, and Larson devices represents an advance over prior attempts, the search continues for a system capable of effectively creating a substantially constant volume of a concentrated chemical solution from a solid block of chemical wherein the solution has a substantially constant concentration over time regardless of a change in dispensing parameters.

SUMMARY OF THE INVENTION

The cleaning system aspect of the subject invention overcomes some of the disadvantages of the prior art, including those mentioned above, in that it comprises a relatively passive, closed loop, solid detergent cleaning system. As used herein, "solid" is to be clearly distinguished from particulate physical forms such as powder, flakes, beads, granules or the like, and is intended to encompass a relatively large monolithic mass of product formed by any suitable means into an observable, structural shape. Suitable methods of manufacture include, inter alia, compression, casting, and the like.

The subject, invention includes a large cleaning tank. Objects that are amenable to being cleaned by a combination of water and a detergent dissolved therein are either placed directly in the tank itself (immersion cleaning) or are placed in an enclosed cabinet with numerous spray nozzles (spray washing), and cleaned by recirculating the cleaning solution from the tank through the spray nozzles onto the objects being cleaned, the solution draining off the objects and returning to the tank, thereby completing the loop. Since the concentration of the detergent is critical to the success of the cleaning operation, the concentration of the water-detergent solution must be monitored, either intermittently by operator testing of the concentration or continuously monitored by means of a conductivity or other sensor. Suspended above the tank, in a suitable housing, is a solid block of detergent. When the detergent concentration within the cleaning tank drops below a predetermined level, the operator or a signal from the concentration sensor activates the pump, which withdraws a portion of the existing solution within the cleaning tank and sprays it onto the solid block of detergent suspended above the tank, thereby causing some of the solid detergent to be eroded from the block such that it is dissolved or suspended in the solution which then returns to the tank. Substantially all of the original solution which is removed from the tank by the pump is returned to the tank as it flows over the solid block. By returning all of the original cleaning solution to the tank, the amount of additional detergent needed to raise the solution concentration to an acceptable level is reduced.

The dispenser aspect of the subject invention includes; a reservoir for retaining concentrated aqueous solution, a means for retaining at least one solid block of a dissolvable chemical, a means for measuring the volume of concentrated aqueous solution in the reservoir and automatically adding fresh water to the reservoir when the volume is below a predetermined minimum amount, a means for measuring the concentration of chemical in the reservoir and automatically spraying concentrated aqueous solution from the reservoir onto the block of dissolvable chemical so as to dissolve a portion of the material and form a highly concentrated recycled solution when the concentration is below a predetermined minimum amount, and a means for conveying the recycled solution into the reservoir to increase the chemical concentration in the reservoir.

DESCRIPTION OF THE PREFERRED EMBODIMENT

Figure 1:
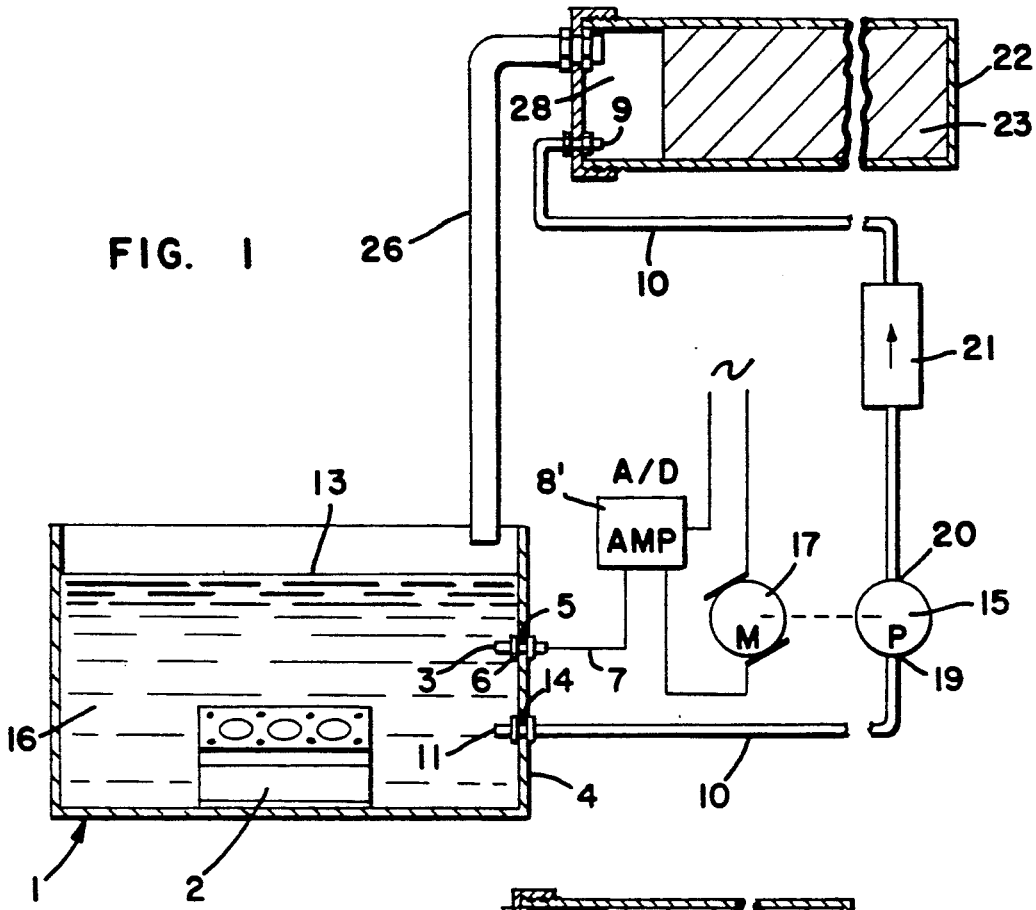
FIG. 1 represents a schematic view of the cleaning system aspect of the invention using an immersion cleaning technique in which operation of the recirculating pump is in response to a signal generated by a conductivity meter.

A preferred embodiment of the cleaning system aspect of the subject invention will now be discussed in detail in conjunction with FIGS. 1 and 2. In this discussion like parts will be designated by like reference numerals insofar as it is possible and practical to do so.

Referring generally to FIG. 1, there is shown a cleaning tank 1. The cleaning tank may be of any convenient shape, but is typically either rectangular or circular in plan and is constructed so as to be watertight. The tank 1 houses water-detergent solution 16, and so must be constructed of materials that are resistant to the caustic or other cleaning agents which will be placed therein. The capacity of the cleaning tank will vary according to the size and number of items to, be cleaned, and will typically range from 100 gallons, to 3,000 gallons. Although the object(s) 2 to be cleaned may be exposed to the cleaning solution for periods of only a few minutes or hours, the tank must be constructed of a material which can withstand the uninterrupted presence of a detergent-water solution for greatly extended periods of time.

Optionally placed within the tank is a conductivity or other sensor 3 which is used to measure the electrolyte balance or other property (such as pH or opacity) within the water-detergent solution. The liquid property sensor location may be varied within the tank such that its position enables the measurement of a representative sample of the solution. Although the cleaning solution may not be entirely homogeneous, most applications will permit the placement of a single sensor at a stationary point within the tank, generally adjacent to the wall 4 of the tank, such that a usable, average value of the solution property being measured may be obtained.

The optimum value of conductivity or other parameter being measured may vary according to the object(s) 2 to be cleaned, the nature of the deposits on the object and the type of detergent being used. Thus, the sensor 3 must have sufficient range to accommodate a variety of water-detergent solutions. The output signal generated by the sensor may be electronically coupled to a meter 27 which may be read by an operator, who may take appropriate action based on some predetermined plan of operation.

In a preferred embodiment an orifice 5 passes through wall 4 of tank 1. A bracket 6 is used to mount the sensor 3 within tank 1, the sensor's data cable 7 exiting the tank 1 through orifice 5. The sensor is connected through cable 7 to a suitable data converting/amplifying unit 8, such as an analog to digital converter, which presents the sensor reading in an appropriate visual display 27.

Also present within the cleaning tank is an outlet 11, the outlet preferably being located some distance away from the conductivity or other sensor 3 in order that the withdrawal of solution from the tank will not artificially affect the conductivity or other reading. The outlet 11 will typically be located at some intermediate depth within the tank since placement of the outlet near the bottom 12 of the tank would tend to collect particulate matter that has settled, while a position near the surface 13 would tend to entrap a large amount of surface film and other floating debris. Only a relatively small amount of solution contaminants will have a specific gravity such that they reside at any particular intermediate depth within the tank.

The outlet 11 leads to an outlet pipe 10 which passes through opening 14 in the wall 4 of tank 1. The outlet pipe 10 is connected to, and is in fluid communication with pump 15, the pump typically being capable of developing a sufficient pressure head to circulate the detergent-water solution 16 to a height of 20 feet above the tank at a flow rate of 15 gallons per minute. The pump 15 itself may be located below the elevation of the outlet pipe 10, if necessary, to satisfy the priming characteristics of the particular pump used. The pump is powered by motor 17, the motor typically being electrically powered. The motor 17 may be operated manually by means of switch 18 in response to readings from the visual display 27, or the motor 17 may be directly interconnected with the conductivity sensor 3 through a suitable converter/amplifier device 8' such that the pump is activated automatically whenever the conductivity reading drops below a certain predetermined level.

A filter 21 may be placed in series with the outlet pipe 10, either on the inlet 19 or outlet 20 side of the pump, in order to remove particulate matter from the water-detergent solution 16 which may be entrained due to the operation of the pump 15. The discharge end 9 of the outlet pipe 10 leads to a cylindrical housing drum 22 which is typically positioned above the cleaning tank and is typically vertically displaced therefrom by several feet. Housed within the drum 22 is a cast solid detergent product 23.

The solid product 23 is typically formed in a cylindrical shape occupying a volume of approximately 4–7cubic feet and weighing approximately 300–500 pounds. The solid product 23 is typically formed during its manufacture in a cylindrical mold, which in the preferred embodiment or this invention is also the drum 22 which houses the solid product 23 above the cleaning tank 1. The solid product 23 is molded so as to leave a freeboard space of about one to four inches at one end (top) of drum 22.

The recirculated water-detergent solution 16 which-exits the discharge end 9 of the outlet pipe 10 enters the drum 22 and passes over the solid detergent product 23. The solution 16 flows freely in the gap 28 created between the end of the drum and adjacent end of the cylindrical solid product. The drum 22 contains an outlet pipe 26 positioned above the cleaning tank 1 such that the water-detergent solution 16 flowing over the solid detergent product 23 may exit freely through the outlet pipe 26 and flow by gravity into the cleaning tank 1. The motion of the water-detergent solution 16 as it cascades over the solid product 23 causes some of the detergent material to erode and be carried as effluent into the cleaning tank 1, thereby increasing the concentration of detergent within the tank or as long as the pump 15 continues to recirculate the water-detergent solution through the cylinder.

Figure 2:
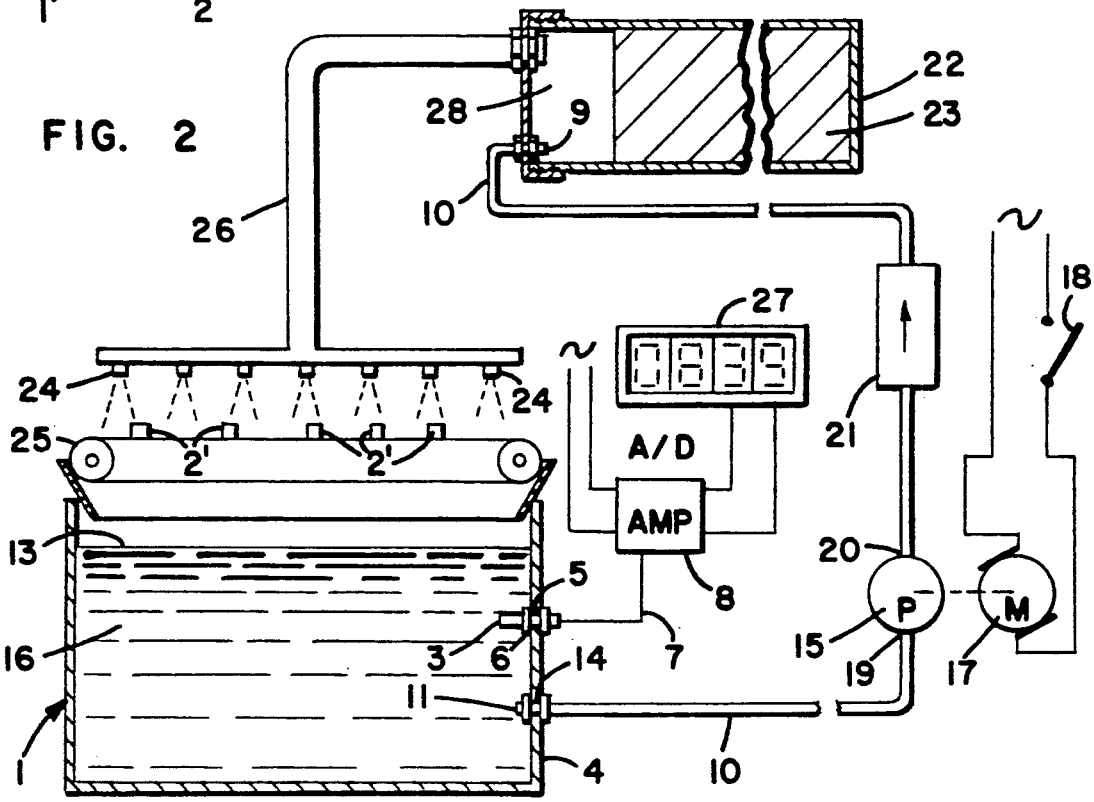
FIG. 2 represents a schematic view of the cleaning system aspect of the invention according to FIG. 1 using a spray washing technique in which a manual control is use to activate the recirculating pump.

In the preferred embodiment shown in FIG. 2, the outlet pipe 26 is connected to an array of spray nozzles (24). The objects 2' to be cleaned are placed on conveyor (25) which transports the objects beneath the nozzles for a predetermined length of time. The water-detergent solution flows through the conveyor (typically constructed of a wire mesh) and returns to cleaning tank 1.

In normal operation, the water-detergent solution 16 within the tank 1 is either ambient, or it may be heated to a temperature of approximately 210° F. At higher temperatures, the motion of the water-detergent solution 16 past the solid detergent block 23 tends to both erode and melt quantities of detergent from the detergent block 23 such that the effluent exits through the outlet pipe 26 and is discharged into the tank 1.

As the concentration of detergent within the cleaning tank 1 begins to increase, the conductivity sensor 3 registers the increase on visual display 27, thereby alerting an operator when the concentration of the solution 16 has reached an acceptable level so that the pump 15 may be turned off. Alternatively, the operator may perform a test to chemically sample the tank's contents.

Alternatively, in a computer controlled or mechanically automated system shown in FIG. 1, the pump 15 will be shut off automatically when the conductivity or other measurement reaches a certain predetermined level. The water-detergent solution 16 will cease to circulate within the system and erosion of the solid detergent block 23 will cease. The concentration of the solution within the cleaning tank will therefore begin to decline gradually, depending upon the rate of detergent consumption within the tank, which is dependent on a number of factors, such as the type of accumulated deposit on the items to be cleaned, the number of items to be cleaned, and the relative surface area of the items 2 to be cleaned. Items having a large number of cavities and orifices tend to have larger surface areas, thereby consuming more detergent per unit time than objects having relatively undulating surface contours. When the solution concentration eventually drops below a predetermined level, pump 15 will again be automatically reactivated, thereby recirculating the water-detergent solution 16 until the concentration level is properly restored.

A key feature of the present invention is the extremely large reduction in the ratio of surface area/-weight of the detergent product utilized. Thus, when the water-dependent solution 16 is brought into contact with the solid product 23 within the cylindrical drum 22, there is no tendency for heat to be produced and the temperature within the drum 22 stabilizes at or near the temperature of the water within the system. Similarly, as the eroded detergent from the product 23 exits through outlet pipe 26 along with the recirculating water-detergent solution 16, there is no tendency for an exothermic reaction to occur when the detergent enters the tank 1, and hence there is no tendency to produce steam or splattering that may be associated with a very rapid heat build-up, such as occurs when similar detergents in particulate form are suddenly introduced into a cleaning tank. The solid detergent 23 may be replaced as it is depleted in complete isolation from the cleaning tank 1 or any moisture. The spent drum 22 is removed and a new drum 22 is fastened in place, requiring only the disconnection and reconnection of inlet pipe 9 and outlet pipe 26.

Although the preferred embodiments disclosed are directed mainly to industrial cleaning applications, the present invention may also be used for a variety of other surface treatment applications. For example, the solid product 23 could be an acid etching agent, priming material or corrosion inhibitor. Each of these surface treating agents could be applied to the object 2 or 2' either through spray nozzles (24) or within cleaning tank 1. The sensor 3 could be substituted to measure any appropriate property relevant to the surface treatment being performed, and the used solution could be recirculated according to a predetermined schedule when the solution concentration dropped to a certain minimum level. The recirculation of the used solution would erode and dissolve solid product 23, thereby increasing the solution concentration to within acceptable limits.

A preferred embodiment of the dispenser aspect of the subject invention will now be discussed in detail in conjunction with FIGS. 3 and 4. In this discussion like parts will be designated by like reference numerals insofar as it is possible and practical to do so.

Figure 3:
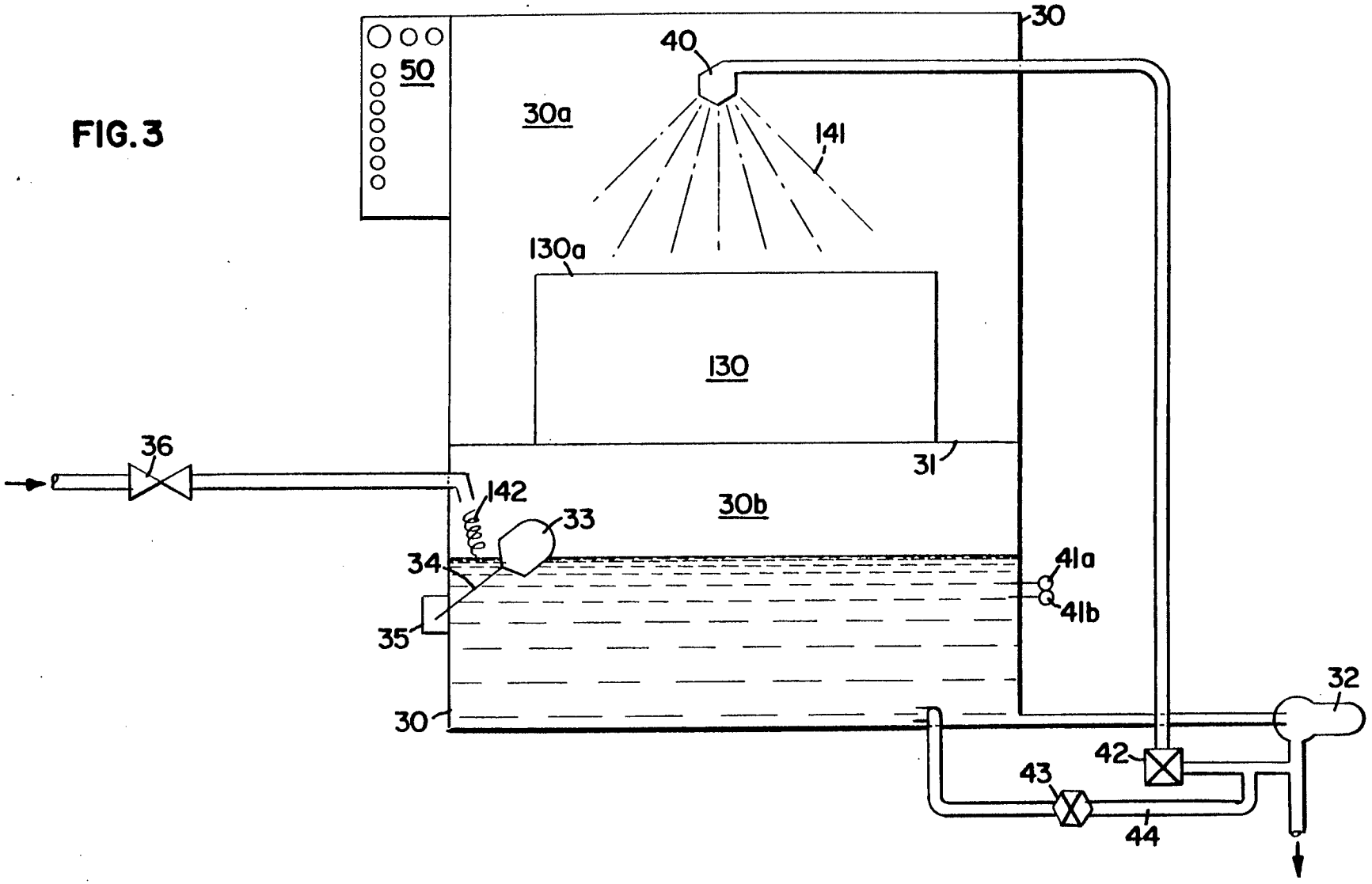
FIG. 3 represents a schematic view of one embodiment of the dispenser aspect of the present invention.
Figure 4:
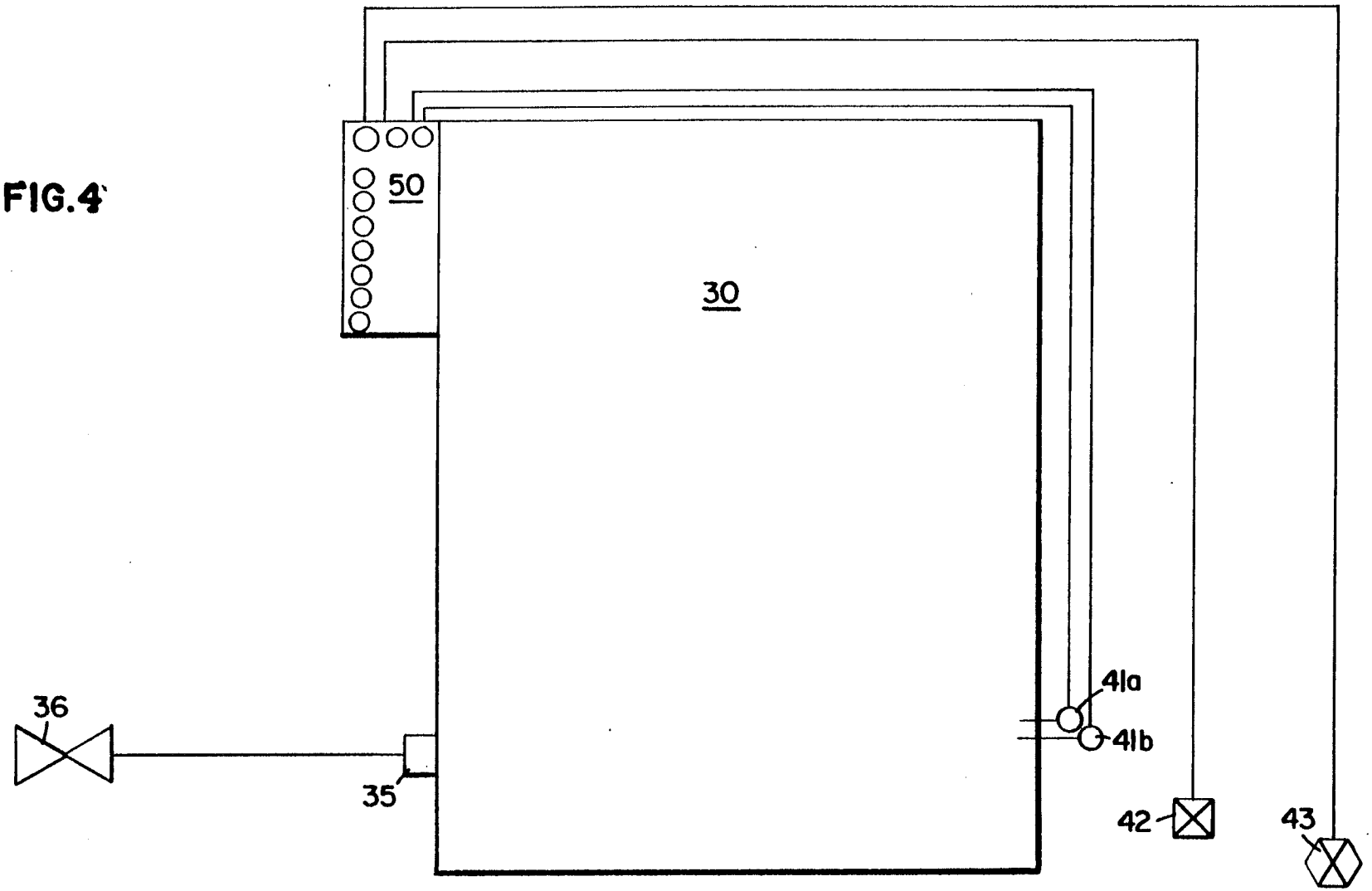
FIG. 4 represents an electrical flow diagram of the dispenser aspect of the present invention as depicted in FIG. 3.

Referring generally to FIGS. 3 and 4 there is shown housing 30 which is separated by perforated member 31 into upper chamber **30*a* and lower chamber 30*b*. Housing 30** may be configured to any convenient shape (typically rectangular or circular) and constructed of any structurally stable material capable of forming a water-tight vessel which can withstand extended contact with the particular chemical solution formed, and stored therein. While the construction material of choice depends upon the type of chemical being dispensed, for most applications materials such as stainless steel and plastics may be employed.

Perforated member 31 must be capable of retaining a solid block of chemical 130 above lower chamber **30*b*** while allowing recirculated aqueous solution 141 to pass back into lower chamber 30b after contacting the solid block of chemical 130. Perforated member 31 may be a perforated plate or a screen and may be constructed from any of the same materials as housing 30.

Upper chamber 30a is configured to retain at least one solid block of chemical 130 and allow the lowermost solid block of chemical 130 to rest upon perforated member 31. Lower chamber 30b is configured to retain chemical solution 140 and allow solution 140 to be readily recirculated and dispensed. The capacity of upper chamber 30a can be varied according to need but will typically range from about 1 to 30 $ft^3$, preferably about 5–15 $ft^3$. The capacity of lower chamber 30b can also be varied according to need but will typically range from about 1–100 gallons, preferably about 3–20 gallons.

Chemical solution 140 is dispensed from lower chamber 30b to a utilization point (not shown) by suitable means such as gravity or pump 32. As chemical solution 140 is conveyed to the utilization point the amount of chemical solution 140 in lower chamber 30b will decrease. When the level of chemical solution 140 in lower chamber 30b reaches predetermined minimum as measured by a suitable volume measuring means such as float 33 and float shaft 34, a suitable switch, such as switch 35 coupled to a float shaft 34, alternates from a first or electrically open state to a second or electrically closed state. When switch 35 is electrically closed it is able to send an activating electrical signal to valve 36 which opens valve 36 to the flow of fresh water 142 therethrough. Fresh water 142 is then allowed to flow into lower chamber 30b wherein it increases the volume of chemical solution 140 therein. Fresh water 142 flows into lower chamber 30b until the volume of chemical solution 140 in lower chamber 30b reaches a predetermined maximum level, as measured by volume measuring means 33/34, at which time switch 35 is returned to an electrically open state and valve 36 is again closed to the flow of water 142 therethrough.

Chemical solution 140 is also conveyed by suitable means, such as pump 32, from lower chamber 30b to spray nozzle 40 when the concentration of chemical solution 140 in lower chamber 30b falls below a predetermined minimum level as measured, by the conductivity of the chemical solution 140. A pair of electrodes 41a and 41b extend into chemical solution 140 retained in lower chamber 30b at a point below the minimum level attained by chemical solution 140 in order to measure the conductivity of aqueous solution 140. For a detailed discussion of the function, design, use and selection of electrodes, see Perry & Chilton, *Chemical Engineers Handbook*, 5th Ed., pp. 22–51 to 22–52 and Kirk-Othmer *Encyclopedia of Chemical Technology*, 2nd Ed., Vol. 7, pp. 726–784, both of which are hereby incorporated by reference. The electrical signal generated by electrodes 41a and 41b is transmitted to control module 50 wherein the signal is compared with a target signal comprising that signal which should be generated by electrodes 41a and 41b when the chemical solution 140 is at the desired concentration. If the signal generated by electrodes 41a and 41b is at or above the target signal a deactivating signal is sent from control module 50 to solenoid valve 42 and valve 42 remains closed. If the signal generated by electrodes 41a and 41b is below the target signal due to such factors as the introduction of fresh water, settling of chemical, etc. an activating signal is sent from control module 50 to valve 42 and valve 42 is opened to the flow of chemical 140 therethrough. Chemical solution 140 is then pumped by pump 32 from lower chamber 30b to spray nozzle 40 where it is sprayed onto solid block of chemical 130 (preferably into initial contact with top surface 130a of solid block of chemical 130). The recirculated aqueous solution 141 is emitted under pressure from spray nozzle 41, contacts the solid block of chemical 130, dissolves a portion of the solid of chemical 130, passes through perforated member 31 and then recombines with chemical solution 140 retained in lower chamber 30b.

Chemical solution 140 is recirculated until the concentration of chemical solution 140 in lower chamber 30b reaches the desired concentration, at which time electrodes 41a and 41b will transmit a signal equal to or greater than the target signal and control module 50 will emit the deactivating signal to valve 42, closing valve 42 to the flow of solution 140 therethrough and stopping recirculation of chemical solution 140.

To assist in maintaining solution 140 retained in lower chamber 30b in a homogenous state, thereby ensuring proper dispensing and reducing false conductivity readings, conduit 44 continuously recirculates solution 140 so as to create a mixing motion in the solution 140. Valve 43 allows manual regulation of the flow rate of solution 140 through conduit 44.

The preferred pump 32 is an air operated double diaphragm pump such as is available from ALL-FLO Pump Company of Stow, Ohio. Use of an air operated pump eliminates the need to electrically connect pump 32 to control module 50 as air operated pumps actively pump only when a pressure differential exists between the inlet and outlet orifices in the pump and only so much as is needed to match the inlet and outlet pressure. In the present invention pump 32 actively pumps chemical solution 140 only when (i) the utilization point opens to the flow of solution 140, (ii) valve 42 opens to the flow of solution 140, and/or (iii) valve 43 opens to the flow of solution 140.

The dispenser provides a substantially constant amount of an aqueous chemical solution 140 at a substantially constant concentration regardless of variances in such variables as the amount of aqueous solution 140 dispensed, the temperature of recirculated aqueous solution 141 sprayed onto solid block of chemical 130, solubility and amount of exposed surface area, and the like.

While the preferred embodiment is depicted as having water supply valve 36 directly controlled by level control switch 35, valves 42 and 44 controlled by control module 50 and pump 32 free from any direct control, it is possible to have pump 32, control switch 35, valves 36, 42, and 44 all controlled directly by control module 50.

The specification is presented to aid in the complete, nonlimiting understanding of the invention. Since many variations and .embodiments of the invention can be made without departing from the spirit and scope of the invention, the invention resides in the claims hereinafter appended.

We claim:

1. A recirculating solid detergent cleaning system utilizing a liquid detergent solution, comprising:

(a) reservoir means for containing the liquid detergent solution;

(b) means for measuring detergent concentration of the liquid detergent solution, said concentration measurement means being located in said reservoir containing means;

(c) means for removing the liquid detergent solution from the reservoir containing means;

(d) a solid detergent, the solid detergent having a tendency to erode and dissolve when brought into contact with a liquid solution; and (e) spray means for bringing the removed liquid detergent solution from the means for removing the liquid detergent into contact with the solid detergent, such that the solid detergent erodes, the eroded solid detergent and the removed liquid detergent solution thereby flowing into the reservoir containing means by a liquid detergent return means wherein said spray means directs the solution onto an upper surface of the solid detergent, and the solution flows into the reservoir containing means.

2. The cleaning system of claim 1 wherein the solution containing means is formed as a tank, the tank being in fluid communication with the suspended solid detergent.

3. The cleaning system of claim 1 wherein the means for measuring the detergent concentration of the liquid detergent solution includes an electrical conductivity sensing probe for testing conductance as a measure of detergent concentration within the liquid detergent solution, the sensor generating a signal proportional to the measured conductance, pH or opacity of the solution.

4. The cleaning system of claim 1 wherein the means for removing the liquid detergent solution from the containing means includes a pump.

5. The cleaning system of claim 1 wherein the solid detergent is formed as a cast solid detergent product, the product being formed generally as a cylinder.

6. The cleaning system of claim 5 further comprising solid detergent housing means including a hollow cylindrical drum, which drum is also the shipping container for the solid detergent, said drum being compatibly shaped so as to fully encompass the cast solid detergent product, the drum containing an entrance orifice and an exit orifice, the entrance orifice permitting introduction of the liquid detergent solution within the drum.

7. The cleaning system of claim 6 further comprising an outlet pipe, the outlet pipe interconnecting the exit orifice of the drum to the tank, such that the eroded solid detergent and the removed liquid detergent solution flow through the outlet pipe into the tank.

8. The cleaning system of claim 3 wherein the sensing probe is interconnected to a visual indicating device in order that the electrical conductivity of the liquid detergent solution may be monitored.

9. The cleaning system of claim 4 wherein the sensing probe is interconnected to a pump controlling device, the pump controlling device operating the pump in response to the signal generated by the sensing probe.

10. A dispenser, comprising:

(a) a reservoir for an aqueous solution;

(b) means for retaining at least one solid block of dissolvable material above the reservoir the sides and upper surface of the solid block being exposed;

(c) means for measuring the volume of aqueous solution in the reservoir and adding fresh water to the reservoir when the volume of aqueous solution is below a predetermined minimum value; the fresh water being added until the volume of aqueous solution in the reservoir reaches a predetermined maximum value;

(d) means for measuring the concentration of material in the aqueous solution in the reservoir and generating a first signal when the concentration is above a preset value and a second signal when the concentration is below said preset value, the concentration measurement means being located so as to take measurements of the solution in the reservoir;

(e) means for spraying aqueous solution from the reservoir onto the top of the block of dissolvable material so as to dissolve a portion of the material with minimal foaming and form a recycled aqueous solution having a concentration of material greater than the aqueous solution in the reservoir;

(f) means for conveying the recycled aqueous solution to the reservoir wherein the recirculated aqueous solution forms part of the aqueous solution retained therein;

(g) control means in communication with the concentration measuring means and the spraying means for receiving the first and second signals from the concentration measuring means and causing the spraying means to spray aqueous solution onto the solid block of dissolvable material only when the second signal is generated; and (h) means for dispensing aqueous solution from the reservoir to a use point.

11. The dispenser of claim 10 wherein the reservoir comprises a 1 to 100 gallon reservoir.

12. The dispenser of claim 10 wherein the aqueous solution is a detergent or soap-based lubricating solution.

13. The dispenser of claim 10 wherein the retaining means is capable of retaining at least 3 solid blocks of dissolvable material above the reservoir.

14. The dispenser of claim 10 wherein the retaining means comprises a perforated plate retained directly above the reservoir.

15. The dispenser of claim 10 wherein the retaining means comprises a screen having 0.1 to 5 cm screen-size openings.

16. The dispenser of claim 10 wherein the concentration measuring means comprises a pair of electrodes in contact with the aqueous solution in the reservoir.

17. The dispenser of claim 10 wherein the spraying means comprises a pump in fluid communication with the reservoir, a spray nozzle in fluid communication with the pump, and a valve interposed between the pump and the spray nozzle for regulating the flow of aqueous solution from the pump to the spray nozzle.

18. The dispenser of claim 17 wherein the dispensing means includes the pump which forms a part of the spraying means.

19. The dispenser of claim 18 wherein the pump is an air operated double diaphragm pump.

20. The dispenser of claim 10 wherein the dispenser further comprises a means for recirculating aqueous solution in the reservoir so as to maintain the aqueous solution in the reservoir in a substantially homogenous state; the recirculating means comprising the pump which forms a part of the spraying means, a conduit from the pump back to the reservoir, and a valve interposed between the pump and the reservoir so as to regulate the amount of aqueous solution allowed to pass back into the reservoir through the conduit.

21. A method of dispensing a solid block of dissolvable material, comprising the steps of:

(a) placing at least one solid block of dissolvable material into a dispenser, which comprises at least:
(i) a reservoir capable of holding a dispensable aqueous solution;
(ii) means for retaining at least one solid block of dissolvable material above the reservoir;
(iii) means for measuring the volume of aqueous solution in the reservoir;
(iv) means for measuring the concentration of material in the aqueous solution in the reservoir; and
(v) means for spraying aqueous solution from the reservoir onto the top of the block of dissolvable material;
(b) removing aqueous solution from the reservoir;
(c) automatically adding water to the reservoir in response to a signal from the volume measuring means that the volume of aqueous solution in the reservoir is below a predetermined minimum value;
(d) spraying aqueous solution from the reservoir onto the top of the solid block of dissolvable material in response to a signal from the concentration measuring means that the concentration of material in the aqueous solution in the reservoir is below a preset value, so as to dissolve a portion of the material and form a recycled aqueous solution having a concentration of material greater than the aqueous solution in the reservoir; and
(e) conveying the recycled aqueous solution to the reservoir; and
(f) dispensing aqueous solution from the reservoir to a use point.

* * * * *